US008773254B2

(12) United States Patent
Piccolo, III

(10) Patent No.: US 8,773,254 B2
(45) Date of Patent: Jul. 8, 2014

(54) AUTOMATIC CONFIGURATION OF INITIATING DEVICES

(75) Inventor: Joseph Piccolo, III, Fitzwilliam, NH (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 273 days.

(21) Appl. No.: 13/193,322

(22) Filed: Jul. 28, 2011

(65) Prior Publication Data

US 2012/0068842 A1 Mar. 22, 2012

Related U.S. Application Data

(63) Continuation-in-part of application No. 12/884,818, filed on Sep. 17, 2010, now Pat. No. 8,378,806, and a continuation-in-part of application No. 12/970,035, filed on Dec. 16, 2010.

(51) Int. Cl.
*G08B 23/00* (2006.01)

(52) U.S. Cl.
USPC ..... 340/501; 340/691.1; 340/539.11

(58) Field of Classification Search
USPC ..... 340/501, 506, 517, 627–629, 691.1, 340/692, 512, 505, 531, 539.1, 331, 577, 340/538, 521, 533, 630, 286.05, 539.11
See application file for complete search history.

(56) References Cited

U.S. PATENT DOCUMENTS

| | | | | |
|---|---|---|---|---|
| 5,515,034 A | | 5/1996 | Otsuka et al. | |
| 5,608,375 A | * | 3/1997 | Kosich | 340/293 |
| 5,705,979 A | * | 1/1998 | Fierro et al. | 340/517 |

(Continued)

FOREIGN PATENT DOCUMENTS

| | | |
|---|---|---|
| EP | 1 182 630 | 2/2002 |
| WO | WO 2004028115 A | 4/2004 |
| WO | WO 2006/049614 | 5/2006 |
| WO | WO 2009010745 A | 1/2009 |

OTHER PUBLICATIONS

Search Report and Written Opinion issued in corresponding PCT/US2012/042576 dated Aug. 20, 2012 (14 pgs).

(Continued)

*Primary Examiner* — Daniel Previl
(74) *Attorney, Agent, or Firm* — Brinks Gilson & Lione

(57) ABSTRACT

A method and system for configuring initiating devices in a fire alarm system is provided. Groupings of the initiating devices in the fire alarm system are determined entirely automatically (or partially automatically). For example, the fire alarm control panel may communicate with the initiating devices to receive grouping information from the initiating device (which may be input at the initiating device), and determine the grouping based on the communication. As another example, the fire alarm control panel may communicate with the initiating devices in order to determine some aspect of the fire alarm system (such as the wiring), and automatically determine the grouping based on the communication. Moreover, labels for the initiating devices in the fire alarm system may be generated entirely automatically (or partially automatically). Further, reporting of the alarm events by the fire alarm control panel may be based on grouping. For example, the fire alarm control panel may determine the grouping information for the one or more initiating devices that sent an alarm communication, organize presentation of the indication of the alarm event based on the determined grouping information, and present, on an output device, the organized presentation of the indication of the fire alarm event.

20 Claims, 7 Drawing Sheets

(56) References Cited

U.S. PATENT DOCUMENTS

| | | | | |
|---|---|---|---|---|
| 5,943,394 | A * | 8/1999 | Ader et al. | 379/40 |
| 5,943,673 | A * | 8/1999 | Felouzis et al. | 1/1 |
| 5,952,919 | A * | 9/1999 | Merrill | 340/539.18 |
| 6,121,874 | A * | 9/2000 | O'Donnell | 340/506 |
| 6,313,744 | B1 | 11/2001 | Capowski et al. | |
| 6,426,697 | B1 * | 7/2002 | Capowski et al. | 340/506 |
| 7,026,949 | B2 | 4/2006 | Lee et al. | |
| 7,369,037 | B2 | 5/2008 | Piccolo, III et al. | |
| 7,378,966 | B2 | 5/2008 | Agarwal et al. | |
| 2004/0046642 | A1 | 3/2004 | Becker et al. | |
| 2004/0051739 | A1 | 3/2004 | Schmickley et al. | |
| 2007/0008099 | A1 | 1/2007 | Kimmel et al. | |
| 2008/0266076 | A1 * | 10/2008 | Barrieau et al. | 340/506 |
| 2009/0091466 | A1 | 4/2009 | Sendrowski, Jr. | |
| 2010/0315224 | A1 | 12/2010 | Orsini et al. | |
| 2012/0154160 | A1 | 6/2012 | Piccolo, III | |

OTHER PUBLICATIONS

Office Action issued in U.S. Appl. No. 12/970,035 on Jul. 9, 2013 (10 pgs).

International Preliminary Report on Patentability issued in related PCT Application No. PCT/US2012/042576 dated Jan. 28, 2014 (8 pgs).

Office Action issued in U.S. Appl. No. 13/193,322 on Jun. 28, 2013 (10 pgs).

Office Action issued in U.S. Appl. No. 12/970,035 on Mar. 5, 2014 (14 pgs).

* cited by examiner

FIG. 7

| COMMUNICATION PORT | SECTION OF BUILDING |
|---|---|
| 9 | 1ST Floor |
| 10 | 2nd Floor |
| 11 | 3rd Floor |

FIG. 8

| SLC | COMMUNICATION PORT |
|---|---|
| 1 | 9 |
| 2 | 10 |
| 3 | 11 |

AUTOMATIC CONFIGURATION OF INITIATING DEVICES

REFERENCE TO RELATED APPLICATIONS

This application is a continuation in part of U.S. patent application Ser. No. 12/884,818 filed on Sep. 17, 2010 now U.S. Pat. No. 8,378,806 and is a continuation in part of U.S. patent application Ser. No. 12/970,035 filed on Dec. 16, 2010. U.S. patent application Ser. No. 12/884,818 and U.S. patent application Ser. No. 12/970,035 are incorporated by reference herein in their entirety.

BACKGROUND

Typical fire alarm systems include a number of initiating devices positioned throughout a building (and/or a campus). Signals from those initiating devices are monitored by a system controller, such as a fire alarm control panel ("FACP"). The FACP, upon sensing an alarm condition, sends commands to a single notification appliance or multiple notification appliances to alert occupants in one section of the building, in multiple sections of the building, or in some or all sections of the building. Notification appliances can output a visual notification, an audible notification, or both. Examples of initiating devices include, but are not limited to heat detectors, smoke detectors, flame detectors, gas detectors, and the like.

In an addressable fire alarm system, each initiating device has a uniquely assigned address, enabling the FACP to send communications to and receive communications from a particular initiating device. Configuring the addressable fire alarm system requires more manpower. For example, configuration of the addressable alarm system requires setting a unique address at each initiating device (such as through switches or other type of means). As another example, configuration of the addressable alarm system requires entering device identification information (such as a label) for each initiating device.

Because configuring an addressable alarm system is time-consuming and expensive, a need exists to better configure initiating devices in an addressable fire alarm system.

SUMMARY

The present embodiments relate to methods and systems for configuring fire alarm system devices in a fire alarm system. In one aspect, groupings of the alarm devices (such as initiating devices) in the fire alarm system are determined entirely automatically (or partially automatically). The fire alarm control panel communicates with one or more alarm devices in the alarm system and automatically determines at least one grouping for a single alarm device or for multiple alarm devices based at least in part on the communicating with the alarm devices.

As one example, the fire alarm control panel may communicate with the initiating devices to receive grouping information from the initiating device, and determine the grouping based on the communication. In particular, the initiating device may have a grouping input device that receives operator input grouping information (such as a manual input from the operator). The operator input grouping information may be indicative of at least one grouping or particular zone for the initiating device in the fire alarm system, such as a number indicative of a grouping (e.g., in a system with groupings from 1 to 8, the number may be selected from 1 to 8). In this way, the operator input grouping information may be indicative of a particular zone that one initiating device (or a set of initiating devices) are indicated to be in (such as "zone 1" for the first floor). The installation may be made easier since the operator may easily indicate which zone the initiating device is in (such as setting the grouping to "1" to indicate "zone 1"), as opposed to setting an address for the initiating device. The grouping input device may be a switch (such as an electromechanical switch), a jumper, a dial (or other movable control knob), or other manual input device. Or, the grouping input device may include a device which is configured to receive a wireless input from the operator. The initiating device sends a communication to the fire alarm control panel that is indicative of the operator input grouping information. The initiating device may send the communication in response to a command received from the fire alarm control panel to send the operator input grouping information, or in response to a predetermined event at the initiating device (such as at startup of the initiating device). In this way, the operator input grouping information may assist in assigning some indication to the initiating device. The indication may be in place of or in addition to the setting of an address of the initiating device.

As another example, the fire alarm control panel may communicate with the initiating devices in order to determine some aspect of the fire alarm system (such as the wiring), and automatically determine the grouping based on the communication. In particular, automatic grouping may use the wiring of the fire alarm system in order to automatically form the groupings of initiating devices (such as grouping the initiating devices based on the signal line circuit to which they are connected). The fire alarm control panel may have one or more communication ports, with wiring connected to each of the communication ports forming signal line circuits, which further have one or more initiating devices connected thereto. For example, wiring on the first floor of a building may be connected to one communication port (such as communication port #1) of the fire alarm control panel. The initiating devices that are connected to the wiring on the first floor may be grouped in a single grouping, with an indicator such as "first floor"; "zone 1"; "#1"; or "communication port #1".

In another aspect, labels for the initiating devices in the fire alarm system are generated entirely automatically (or partially automatically). The labels may be automatically generated based on wiring of the fire alarm system and/or based on grouping information (such as grouping based on the particular signal line circuit to which the initiating device is connected). The automatic generation of the label may be based on operator input or not based on any operator input. For example, the initiating devices associated with a particular communication port (such as communication port #1) may be automatically assigned the label "1". Or, the operator may input that the wiring to the particular communication port is associated with a particular part of the building (such as the $1^{st}$ floor), and the automatic label may assign "$1^{st}$ floor" as the label to each of the initiating devices in communication with the particular communication port. The labels may also be automatically generated based on topology of the initiating device within the fire alarm system, based on the unique address of the initiating devices, and/or based on auto-addressing sequence information for the initiating devices.

In still another aspect, the initiating device is configured to receive grouping information at the initiating device. The initiating device may have a grouping input device that receives operator input grouping information (such as a manual input from the operator), as discussed above. The operator input grouping information may be indicative of at least one grouping for the initiating device in the fire alarm system, such as a number indicative of a grouping (e.g., in a system with groupings from 1 to 8, the number may be selected from 1 to 8). The initiating device may further include a communications interface configured to communicate with a fire alarm control panel in a fire alarm system, a memory configured to store the operator input grouping information, and a controller. The communications interface may enable communication with the fire alarm control panel, such as sending communications to or receiving commands from the fire alarm control panel. The communication to the fire alarm control panel may comprise a status report in response to a command to report the status of the initiating device or may comprise a grouping report of the grouping information of the initiating device in response to a command to report the grouping information of the initiating device.

In yet another aspect, reporting of the alarm events by the fire alarm device is based on grouping. Initiating devices sense at least one criterion, and send an alarm communication to the fire alarm control panel when the sensed criterion is in a predetermined range. The fire alarm control panel determines the grouping information for the initiating devices that sent an alarm communication, organizes presentation of the indication of the alarm event based on the determined grouping information, and presents, on an output device, the organized presentation of the indication of the fire alarm event. Thus, instead of reporting an alarm event for each initiating device that sent an alarm communication, the fire alarm control panel reports the alarm events based on the grouping of the initiating devices that sent the alarm communication.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

FIG. 7 is a table correlating communication ports with locations in a building.

FIG. 8 is a table correlating SLCs with communication ports.

DETAILED DESCRIPTION

Figure 1:
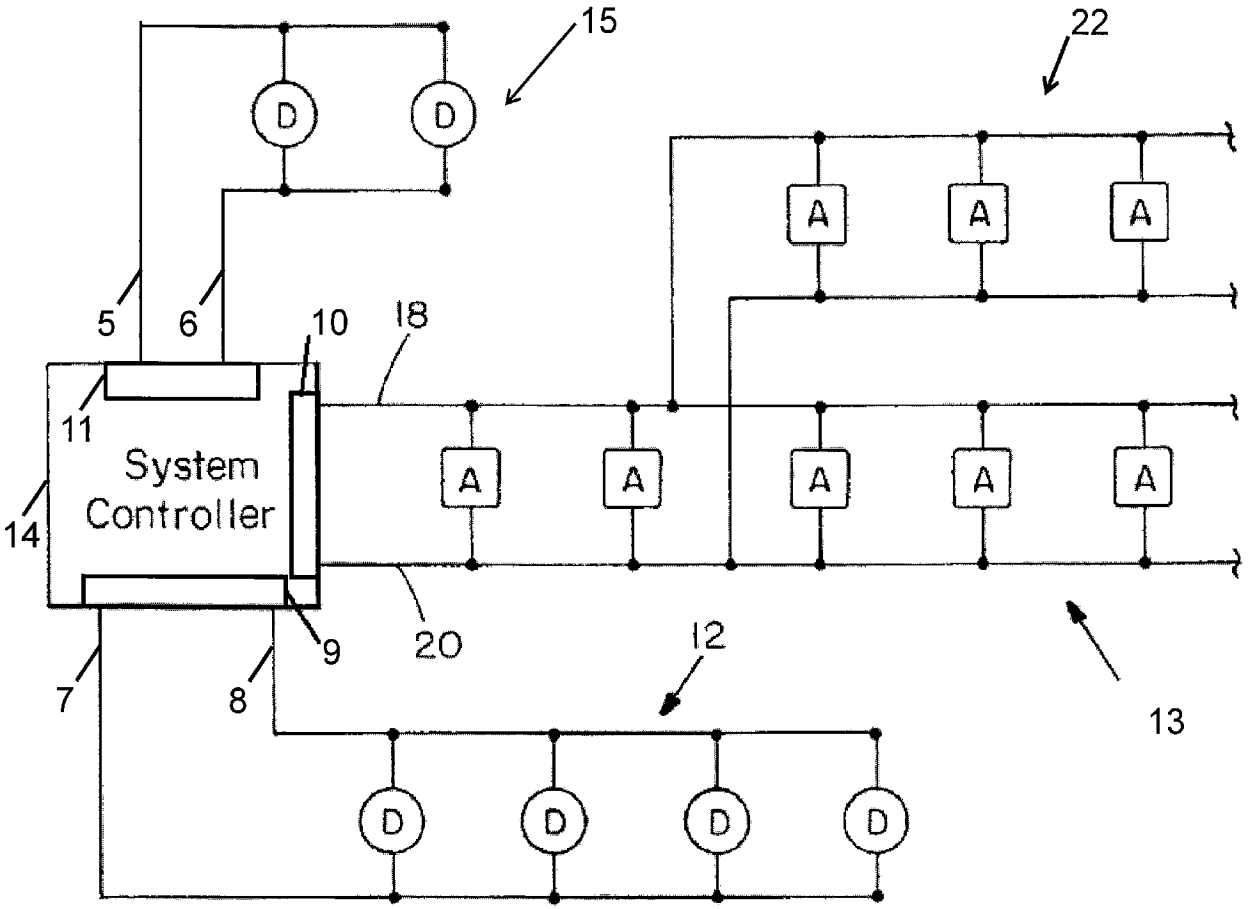
FIG. 1 is a schematic diagram illustrating a fire alarm system.

A system embodying one example of the present invention is illustrated in FIG. 1. The system includes a system controller 14 (such as a fire alarm control panel (FACP)), alarm initiating devices D, and alarm system notification appliances A. The system may be configured in different ways, such as depicted in FIG. 1.

FIG. 1 further depicts two notification appliance circuits 13, 22. However, fewer or greater number of appliance circuits may be used in the alarm system. FIG. 1 further depicts two initiating device circuits 12, 15. However, a fewer or a greater number of initiating device circuits may be used in the alarm system. The notification appliance circuits 13, 22 and the initiating device circuits 12, 15 include one or more wires that emanate from a NAC or detector loop interface 9, 10, and 11 of the system controller 14. More specifically, one, some, or all of the wiring for an appliance circuit may emanate from interface 9, 10, or 11 of the system controller 14. As discussed below, the wiring emanating from the communication port may be used in the automatic configuration described herein.

The example in FIG. 1 depicts that all of the fire alarm system devices (including initiating devices and notification appliances) on a signal output circuit are coupled across a pair of power lines, such as 5 and 6, 7 and 8, 18 and 20, although this is not necessary for carrying out the invention. Lines 5 and 6 may carry communications between the system controller 14 and alarm initiating devices D on detector circuit 15. Lines 18 and 20 may carry communications between the system controller 14 and notification devices A on appliance circuit 13 and on appliance circuit 22. And, lines 7 and 8 may carry communications between the system controller 14 and alarm initiating devices D on detector circuit 12.

The appliance circuits may have alarm initiating devices D, alarm system notification appliances A, or both alarm initiating devices D and alarm system notification appliances A. For example, FIG. 1 depicts two notification appliance circuits (NAC) 13, 22 that include alarm system notification appliances A, as discussed above. Alternatively, the alarm system may include an initiating device/notification appliance circuit (ID/NAC) that includes both initiating devices D and alarm system notification appliances A. Again, FIG. 1 is merely for illustration purposes. Fewer or greater numbers of appliance circuits may be used, fewer or greater notification appliance circuits may be used, fewer or greater initiating device circuits may be used, and, one or multiple ID/NACs may be used.

The system may further include one or more single-ended stub circuits 22, such as shown in FIG. 1. For example, one of the circuits, such as appliance circuit 22, may comprise a stub circuits, also referred to as "T-tapping". T-tapping provides a number of advantages, such as reducing the wire material and installation costs, and allowing for increased NAC wiring distances.

The system controller 14 may monitor the alarm initiating devices D. When an alarm condition is sensed, the system controller 14 may signal the alarm to the appropriate notification appliances A through the one or more notification appliance circuits. Initiating devices may include any automatically actuated device configured to respond to one or more detectable physical changes associated with an alarm condition (such as a detectable physical changes associated with fire). For example, the initiating devices may include one, some, or all of the following: heat detector, smoke detector, flame detector, gas detector (such as a carbon monoxide detector). The initiating devices may be automatically actuated devices. Alternatively (or in addition to), the initiating devices may comprise manually actuated devices, such as break glass stations, buttons, manual pull stations, or the like. Notification appliances may include, for example, a visual alarm (such as a strobe), an audible alarm (such as a horn or speaker), or a combination thereof. Also, a speaker for broadcasting live or prerecorded voice messages and a strobe may be combined into a single unit (S/V device). As discussed in more detail below, a visible indicator (such as an LED) may be provided on any of the above-described initiating devices D, with the LED also being controlled by the system controller 14. For example, the LED may be operated under commands (described below) such that the LED blinks every time the initiating device D is polled (such as a broadcast command that indicates a request to poll).

The system controller 14 may communicate with the initiating devices D and the notification appliances A. Examples of commands issued for a fire alarm system are disclosed in U.S. Pat. No. 6,426,697, which is hereby incorporated by reference in its entirety. Further, the system controller 14 may send one or more commands relating to diagnostics, status, or other non-alarm type events. For example, the system controller 14 may send a command related to the identification, the configuration, and/or the status of the initiating devices D and/or the notification appliances A. Moreover, the initiating devices D and/or the notification appliances A may respond in kind.

The command from the system controller 14 can, for example, be multiplexed onto the device's power line (such as lines 5 and 6, 7 and 8, or 18 and 20), providing the added benefit that it saves the cost of additional wiring to devices. Alternatively, the communication line to the device may be separate from the power line. The communications channel may comprise, for example, a wireless link, a wired link or a fiber optic link.

Figure 2:
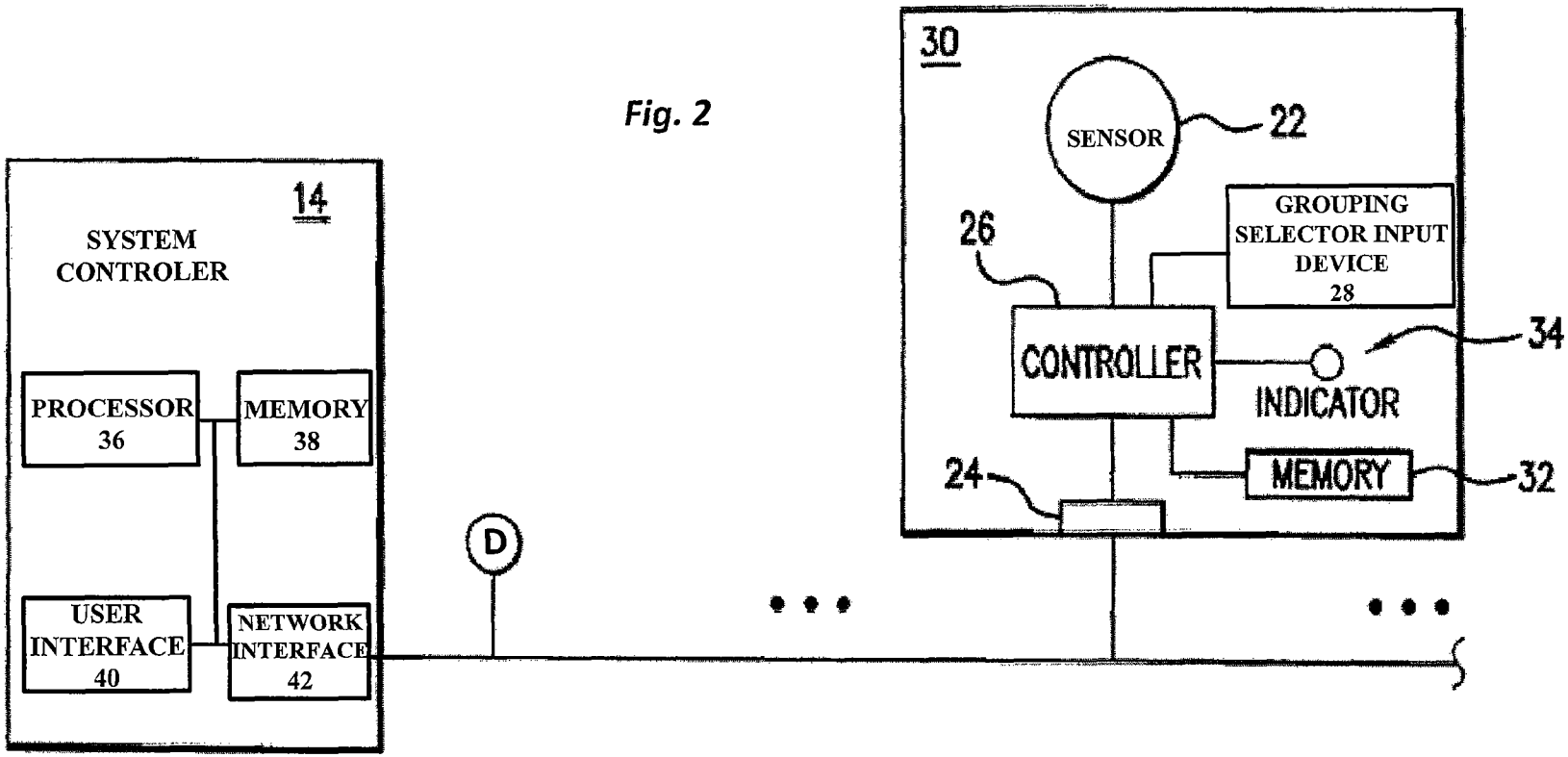
FIG. 2 is a schematic diagram of the system of FIG. 1, further illustrating details of an embodiment of the present invention.

FIG. 2 is a schematic diagram of the system of FIG. 1, using a general example of an initiating device 30. As discussed above, the initiating device may include an automatic actuated device, such as a smoke detector, a flame detector, a gas detector, or the like. These examples of the initiating devices D are merely for illustration purposes only. Other initiating devices D may be used. For simplicity, the two-line communication setup of FIG. 1 is shown with a single line. Communication signals to and from the fire alarm control panel 14 may be multiplexed onto the device's power line, as discussed above. Alternatively, communications signals may be on a communication line that is separate from the power line. For example, a fiber optic cable link or a wireless connection can be utilized. Alternatively, or in addition, the initiating device 30 may directly communicate with the fire alarm control panel 14 using for example, optical signaling (for example, an LED, an infrared emitter, etc.). The initiating device 30 may also communicate using other means, such as RF tag reading or audio (e.g., ultrasonic, chirps, beeps, prerecorded or synthesized voice, etc.)

The system controller 14 includes a processor 36, a memory, 38, a user interface 40, and device interface 42. User interface 40 may comprise a display monitor (a series of lights or other visual indicator) and/or a keyboard (or other input device such as a mouse, table, or the like). The device interface 42 is configured to be a wired or wireless device interface for the system controller 14. In one example, the device interface may comprise a loop interface.

Initiating device 30 comprises a communication interface 24, a controller 26, a sensor 22, a memory 32, an indicator 34, and a grouping select input device 28. The initiating device 30 communicates with the system controller via the communication interface 24. The controller 26, such as a microprocessor, microcontroller or hardwired logic, receives commands from and sends data to the system controller 14. For example, the system controller 14 may send a command to request a response from the initiating device 30, the command including a request as to the status of part or all of the initiating device 30 (such as grouping selection). Or, the system controller 14 may send a command to configure the initiating device 30.

The initiating device 30 may send a communication in response to an alarm event. In particular, the sensor 22 may provide sensor information for one or more physical criteria (such as a heat indication, flame indication, gas indication, etc.). The output of sensor 22 is sent to controller 26, which determines whether the sensor information indicates an alarm event (such as a fire alarm). The controller 26 may access memory 32 to determine whether the sensor information provided by the sensor is within acceptable limits indicative of a fire. In the situation where the controller 26 determines that the sensor information indicates an alarm event, the controller 26 sends a communication (via the communication interface 24) to the system controller 14. The communication sent from the initiating device 30 provides information as to the identification of the particular initiating device 30 and an indication of the alarm event.

Although shown separately, the memory 32 may be integrated with the controller 26. The indicator 34, such as a flashing LED, may indicate a current configuration of the initiating device 30, for example, upon command from the system controller 14, upon a local manual command such as a pushbutton (not shown), on a periodic basis, always, or upon some other event.

Initiating device 30 further includes grouping selector input device 28. Grouping selector input device 28 may comprise a device which is configured to receive an input from an operator, such as a manual input from the operator. The input from the operator is indicative of at least one aspect of a grouping for the initiating device 30. The aspect of the grouping for the initiating device may include a number or a letter indicative of a grouping. For example, the initiating devices may be grouped from 1 to 8, with the number of the grouping (selected from 1 to 8) indicative of a grouping. The examples of the aspect of the grouping are provided merely for illustration purposes. Other aspects of grouping that may be manually input are contemplated.

Grouping selector input device 28 may include a switch (such as an electromechanical switch), a jumper, a dial (or other movable control knob), or other manual input device. The operator may provide a manual input to grouping selector input device 28, such as by setting the switch, moving the dial, or the like. For example, the dial may include eight different settings, with each of the settings comprising a selection of the number of the grouping from 1 to 8.

Or, grouping selector input device 28 may comprise a device which is configured to receive a wireless input that is initiated by a manual input from the operator. For example, grouping selector input device 28 may include an optical sensor (e.g., an infrared sensor) that is configured to receive an optical input from an operator who is proximate to the initiating device 30 (such as in a direct line of sight in order to receive an optical input). The operator may provide a wireless input to grouping selector input device 28, such as by sending a wireless signal (such as a Bluetooth signal).

Grouping of the initiating devices may be configured in one of several ways. One way is to automatically configure the grouping, such as by automatically configuring the grouping based on wiring of the initiating devices in the fire alarm system. Another way is to manually configure the grouping, such as by inputting grouping information at the initiating device.

Figure 3:
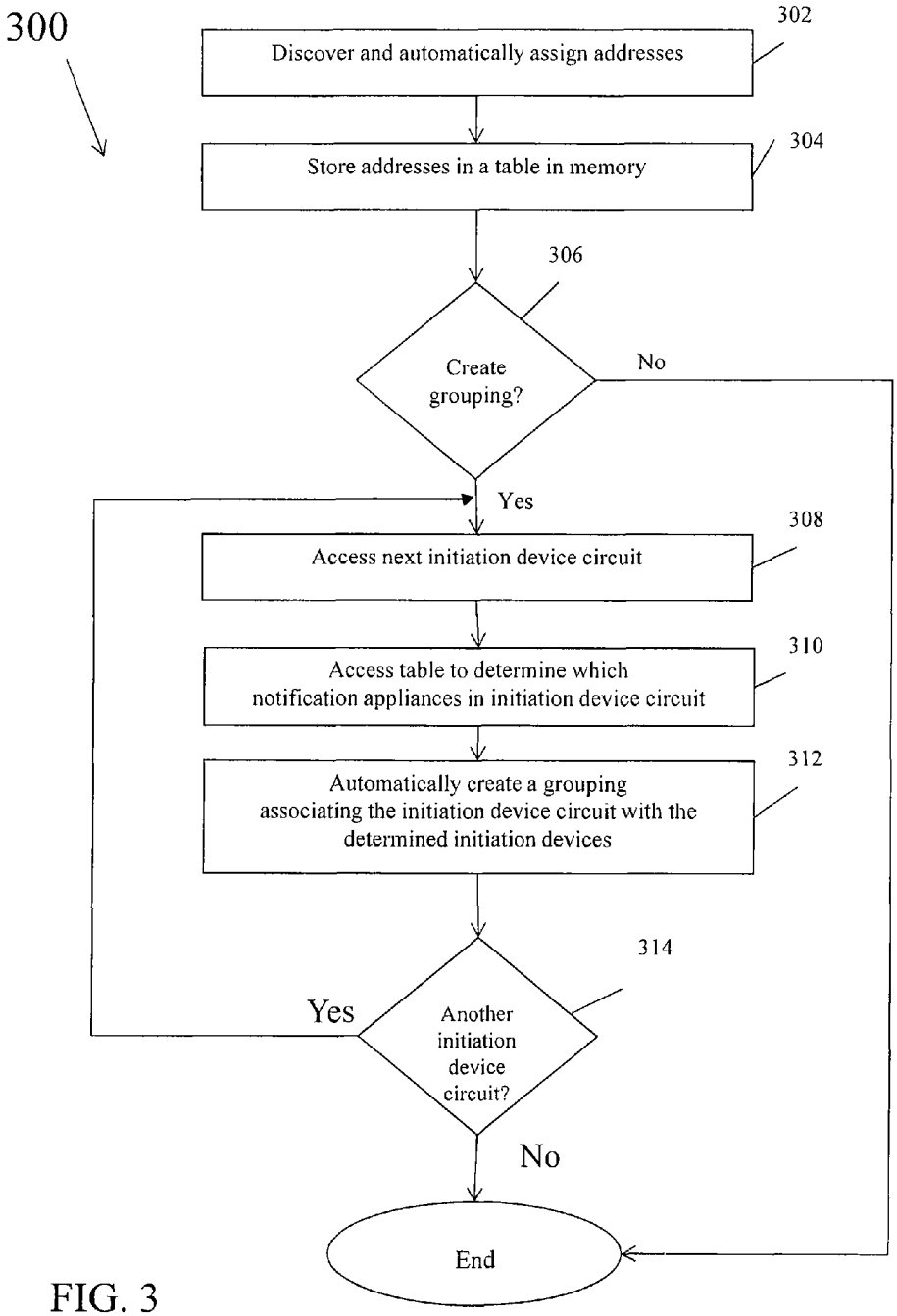
FIG. 3 illustrates a flow chart of one example for automatically grouping one or more initiating devices.

FIG. 3 is a flow chart 300 of an exemplary process for automatic grouping of initiating devices. Automatic grouping of the initiating devices may be used in combination with automatic assigning of addresses of one, some, or all of the initiating devices in the fire alarm system. At block 302, the fire alarm control panel discovers and automatically assigns addresses of the initiating devices. Next, at block 304, the unique addresses may be stored in a table (or other data structure) in memory (such as memory 38). Along with the unique addresses, a reference to the signal line circuit (SLC) to which the initiating device is connected may be stored as well. More specifically, at least one aspect of the wiring of the system related to one or more SLCs are stored. One example of the aspect of the wiring of the system may include a look-up table (or other data structure) that correlates communication ports with sections of a building. As discussed above, multiple interfaces (such as 9, 10, and 11 depicted in FIG. 1) may be used. The look-up table may correlate a particular port, such as communication port 10, with a section of the building, such as the lobby, $2^{nd}$ floor, etc. An example of the look-up table is illustrated in FIG. 7. In this way, the different ports may be correlated with wiring in different sections of the building. And, this information may be used in subsequent automatic configuration, as discussed in more detail below.

Each assigned address may be unique for a part of the alarm system (such as a branch of wires) or may be unique to the entire alarm system. See US Published Application No. 2009/010745 A1, incorporated by reference in its entirety. Further, the appliances in the fire alarm system may be identified in a variety of ways. See US Published Application No. 2010/0176931 A1, incorporated by reference in its entirety.

An exemplary method for automatically assigning addresses uses a unique number (for example, a serial number or other unique identifier) inside the initiating device. The unique number may be stored in a memory (such as memory 32) upon manufacture. The system controller 14 may broadcast a series of messages. For example, the system controller 14 may first broadcast a message requesting all initiating devices that have not been assigned a unique address to respond if the initiating device has a unique number with a last digit of "0". If the system controller 14 receives via device interface 42 a coherent response, only one initiating device responded. In this case, the system controller sends a follow-up message that the initiating device with the unique number with a last digit of "0" is assigned some unique address "XX". The system controller 14 may save the unique address "XX" and associate it with the SLC from which the communication was sent in memory 38. If the system controller 14 receives via I/O 42 an incoherent response, then more than one initiating device responded. The system controller 14 may then send a subsequent broadcast message, requesting the initiating devices that have not been assigned a unique address to respond if the initiating device has a unique number with a last two digits of "10". If only one initiating device responds, then the system controller 14 assigns a unique address YY to that device. This procedure may be done iteratively until all of the initiating devices have been assigned a unique address. Of course, one skilled in the art would recognize that other techniques for discovering initiating devices or other devices on an initiating device circuit or SLC and assigning addresses may be used.

At block 306, it is determined whether groupings are to be created. If not, the method ends. If so, at block 308, the next signal line circuit (SLC) is accessed. In the case of the first pass of the loop shown in flow chart 300, the first SLC is the "next" SLC. For example, the SLC connected to communication port 10 may be accessed first. A fire alarm control panel may have one or more ports to the SLCs. Depending on the protocol used, an SLC can monitor and control several hundred devices. The devices connected to each SLC, which can number from a few devices to several hundred, for example, may be polled. Further, a fire alarm system may have multiple SLCs, with the SLCs being further divided into sub-groups, such as through the use of fault-isolation modules.

Each device on a SLC may be assigned its own unique address (such as via block 302), such that the system controller 14 may individually address each of the devices. Addressable devices include, but are not limited to, notification appliances, initiating devices such as smoke detectors, heat detectors, manual call points, manual pull stations, responders, fire sprinkler system inputs, switches (including flow control, pressure, isolate, and standard switches), and output devices (e.g., relays, such as warning system/bell relays, door holder relays, auxiliary (control function) relays), etc.

For example, a fire alarm system may be installed in a 4-story building, with there being four SLCs (SLC#1 for the first floor, SLC#2 for the second floor, SLC#3 for the third floor, and SLC#4 for the fourth floor). Each of the SLCs may have its wiring emanate from a different communication port of device interface 42 in the system controller 14. Further, a look-up table may correlate the SLC and its associated communication port, such as shown in FIG. 8. Moreover, another look-up table may correlate the communication ports with the sections of the building, such as shown in FIG. 7. For example, a first interface (such as port 9) may be associated with SLC#1, and may be correlated to the first floor. A second interface may be associated with SLC#2, and may be correlated to the second floor, and so on. Though two separate look-up tables are disclosed, one look-up table may include the information disclosed in the look-up tables illustrated in FIGS. 7 and 8. Further, the look-up tables may be included in a single memory device, or in multiple memory devices. Alternatively, the SLCs may be automatically assigned to "zone 1", "zone 2", etc.

At block 310, the table which may contain the unique addresses of the initiating devices and the SLC to which each initiating device is connected is accessed. The system controller 14 may automatically create a grouping associating all of the initiating devices on a particular SLC, as shown at block 312. In this way, an indicator of the grouping may be correlated with the unique addresses for the determined initiating devices connected to the signal line circuit. And, the grouping may be stored in the table (or other data structure) in the memory 38 that also stores the unique address information. Alternatively, the grouping may be stored in a table (or other data structure) in the memory 38 that is separate from the table that stores the unique address information. At block 314, the process checks whether there are any other SLCs. If so, control loops back to block 308 and selects the next SLC. If there are no other SLCs, the process ends.

In this way, the initiating devices may be automatically grouped according to which SLC each initiating device is connected. The reliance on the wiring for the automatic grouping reduces the amount of programming needed to group the initiating devices, in effect reducing the effort to group initiating devices to approximately that of a non-addressable system.

Figure 4:
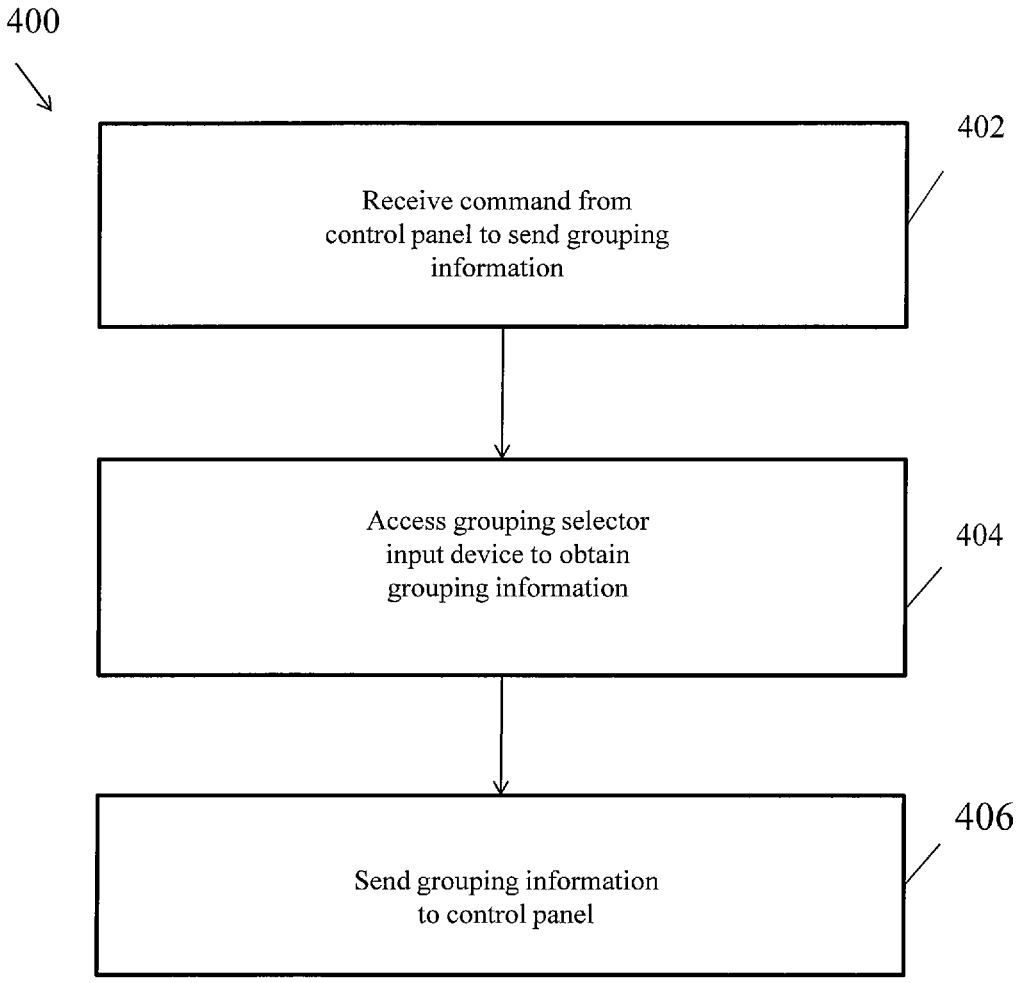
FIG. 4 illustrates a flow chart of another example for automatically grouping one or more initiating devices.

FIG. 4 is a flow chart 400 of an example of a manual grouping of the initiating devices. As discussed above, the fire alarm control panel may send a command to the initiating device for the initiating device to report its grouping information. At 402, the initiating device receives a command from the fire alarm control panel to send grouping information. As discussed above, different aspects of grouping information may be entered, such as a number indicative of grouping. At 304, the controller of the initiating device may access the grouping selector input device 28 in order to obtain the grouping information. Alternatively, the grouping information may be stored in the memory 32 of the initiating device, and the controller may access the memory 32 to obtain the grouping information. At 306, the initiating device may send a communication that includes an indication of the grouping information to the fire alarm control panel. The communication to the fire alarm panel that indicates the grouping information may take one of several forms. For example, the communication may include a field that includes the indication of the grouping information.

As disclosed in FIG. 4, the grouping information is communicated to the fire alarm panel in response to the initiating device receiving a command. Alternatively, the initiating device may send the grouping information to the fire alarm control panel on its own initiative, such as upon startup or initialization of the initiating device.

The installer typically configures custom labels to identify each of the initiating devices in the alarm system. The custom label is a description, in words, numerals or other characters, of the location of the initiating device (such as "$5^{th}$ floor conference room"). The process of assigning custom labels is very labor intensive. For example, if there are 35-50 initiating devices in the alarm system, the installer must assign custom labels to each of them. This entails examining each initiating device, looking up its unique address, and then typing up a custom label. Apart from being difficult, there are times when it is not even possible to assign custom labels. More specifically, if the alarm system is being installed when a building is being built, the custom labels may not be assigned. In the example of the "$5^{th}$ floor conference room", if the conference room has not been finished, the custom labeling may not be finished until after the floor is completed, delaying configuring the alarm system.

Figure 5:
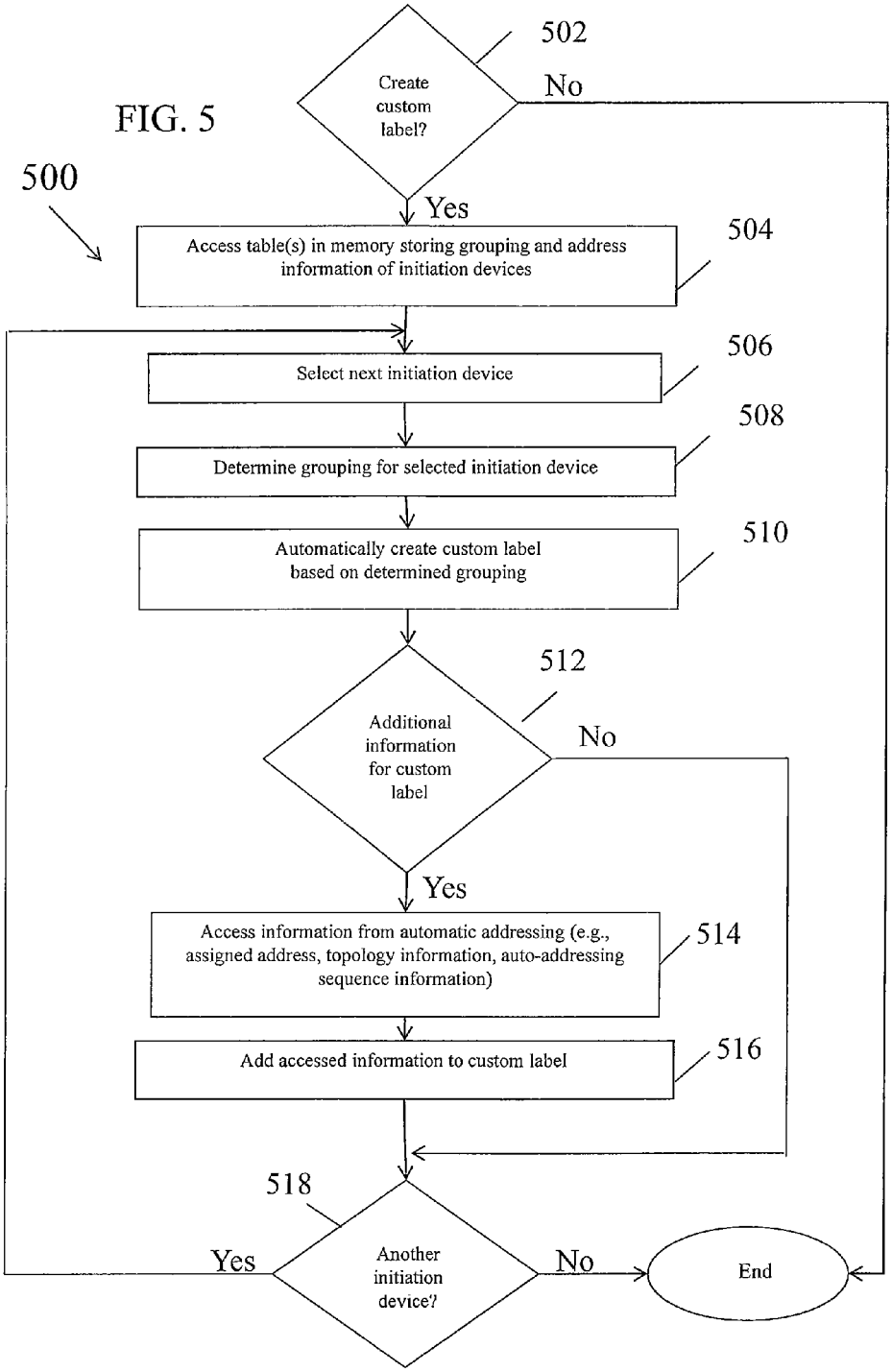
FIG. 5 illustrates a flow chart for automatically labeling one or more initiating devices.

FIG. 5 illustrates a process 500 for automatically labeling one or more initiating devices. At block 502, it is determined whether to create one or more custom labels. If not, the method ends. If so, at block 504, the one or more tables in memory 38 that store grouping and/or address information are accessed. The next initiating device is selected, at block 506. In the case of the first pass of the loop shown in flow chart 500, the first initiating device in the table may be accessed. At block 508, based on the one or more tables, the grouping information is determined for the selected initiating device. For example, an initiating device may be on "Group $1^{st}$ floor", as discussed above.

At block 510, a custom label is automatically created based on the determined grouping. The custom label may comprise an indicator of the determined grouping. The automatically created label may then be stored in the one or more tables. Or, the automatically created label may be stored in a separate section in memory 38. So, in one aspect, the automatically created label may comprise only "zone" information. The zone information may be based on the wiring or the SLC, so that the specificity of the label is dependent on the specificity of the wiring. For example, a particular SLC may be connected to a specific communication port. Without any additional data, each initiating device on the particular SLC may be automatically assigned a particular label, such as "Zone 1". As another example, if the particular SLC is connected to a specific communication port, with the specific communication port previously designated as "$1^{st}$ Floor", the automatically created label may be for "$1^{st}$ floor". As another example, if the SLC is dedicated to the lobby on the first floor, automatically created label may be for "lobby—$1^{st}$ floor". In this way, the wiring may dictate, at least in part, the automatic creation of the label.

Moreover, additional information may be added to (or be used in place of) the grouping information when automatically creating a custom label, as discussed below. At block 512, it is determined whether to add additional information to the custom label. If yes, information is accessed that was generated during automatic addressing, as shown at block 514. At 516, the accessed additional information may be added to the automatically created custom label.

For example, the assigned address may be accessed from the one or more tables. The automatically created custom label may include the grouping information and the unique address of the initiating device. For example, the automatically created custom label may include "lobby—$1^{st}$ floor; 01" or other unique information, e.g., "lobby—$1^{st}$ floor #1", where the grouping information is "lobby—$1^{st}$ floor" and the unique address is "01". As another example, topology of the system may be used. Topology information may comprise the sequence or order of initiating devices along an SLC. For example, the initiating device closest to the fire alarm control panel may be designated the "first" initiating device. The initiating device second closest to the fire alarm control panel may be designated the "second" initiating device, and so on. Using isolators when automatically assigning unique address allows for the determination of this type of topology information, so that during the automatic assigning of unique addresses, the topology information may likewise be stored in the tables, to be used for the creation of the automatically created custom labels. As still another example, the sequence information for assigning of initiating devices may be accessed. In particular, the sequence by which the unique addresses are assigned (such as the fifth appliance to receive a unique address) may be stored in the table for later access when automatically generating the custom labels.

At block 518, the process 500 checks whether there is another other initiating device. If so, control loops back to block 506 and selects the next initiating device. If there are no other initiating devices, the process ends.

After the automatic configuration, the operation of the fire alarm system may be improved. As one example, the system controller 14 may send a query, using the table listing the unique addresses, to a particular initiating device, requesting configuration data of the particular initiating device (such as grouping information). In response, the addressed initiating device may send its current configuration (such as its current grouping information as indicated by the grouping selector input device 28). As another example, the system controller 14 may use the processes described herein for diagnostic purposes. An initiating device failure typically results in one of two situations: (1) the initiating device is able to communicate and can function sufficiently to be identified (e.g., the initiating device can receive a command and generate an aural and/or visual output identifying itself); or (2) the initiating device is unable to communicate with the system controller or cannot function sufficiently to be identified.

In the first situation, the system controller 14 may send a command (such as a diagnostic command) to the initiating device to generate an output, such as switching on indicator 34. The automatically generated custom labels may be used to assist a technician by directing the technician to the general area of the initiating device (e.g., a custom label may indicate "lobby—$1^{st}$ floor). The technician may examine the initiating devices in the area (such as in the lobby—$1^{st}$ floor) to determine which initiating device is generating the requested output. Specifically, the technician may notice that a particular initiating device is generating an output via indicator 34, enabling the technician to identify the malfunctioning initiating device.

In the second situation, the system controller 14 may identify (using the one or more tables) a particular grouping to which the malfunctioning initiating device belongs, and send a command to all of the initiating devices in the particular. All of the devices in the particular grouping that are functioning properly will receive the command and act accordingly (such as generate a request output). The technician may use the automatically generated custom labels to go to the general vicinity of the defective initiating device (such as lobby—1st floor), and the technician may examine the initiating devices in the area (such as in the lobby—1st floor) to determine which initiating device is not generating the requested output. Specifically, the technician may notice that a particular initiating device is the only appliance in the general vicinity that is not generating an output (such as an output with indicator 34). In this way, the diagnostics may combine a partly automated (using automatic addressing, automatic grouping, and/or automatic labeling) and partly manual solution (using the technician) in order to identify a malfunctioning initiating device.

According to the prior art, reporting of alarm events is based on receipt of an alarm event from an initiating device. For example, if multiple initiating devices report an alarm event in a particular area, each of the communications from the multiple initiating devices reporting the alarm event will trigger an output on the fire alarm control panel (or at another centrally located output device indicating the state of the fire alarm system). This amount of information may be excessive to a first responder or other fire department personnel. Rather that providing an indication of each of the initiating devices that report an alarm event, the fire alarm control panel may provide an indication of an alarm event based on the grouping of the initiating devices reporting the alarm event. In particular, the reporting may be based on whether there is any initiating device in a particular grouping (such as the first floor, second floor, etc.) that has reported an alarm event. Receipt of an alarm event from a first initiating device in a particular grouping triggers an output on the fire alarm control panel. The output may include an aural output (such as a bell) and/or a visual output (such as a change in a display). In one embodiment, receipt of additional alarm events from one or more initiating devices in the particular grouping does not change the output or result in a new output on the fire alarm control panel. In an alternate embodiment, receipt of additional alarm events from one or more initiating devices in the particular grouping changes the output or results in a further output on the fire alarm control panel. In particular, the output of the fire alarm panel may still only list one entry (indicating the particular grouping); however, an aural signal and a visual output may be re-initiated (such as sounding a bell or flashing an LED) and the display output may further include a request to the operator of the fire alarm control panel to acknowledge the additional alarm and perform an action (such as pressing an ACK key on an input keypad).

Figure 6:
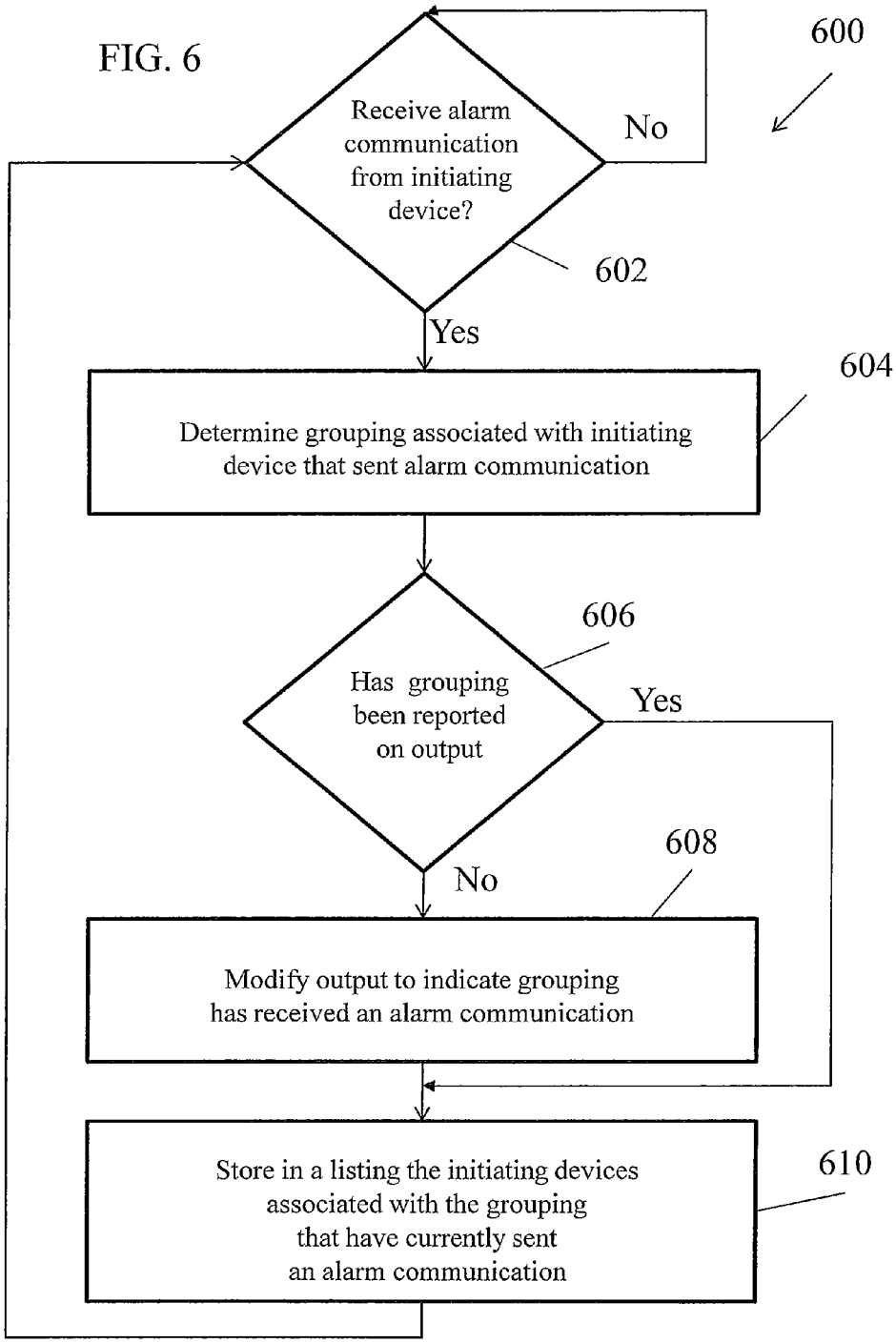
FIG. 6 illustrates a flow chart for reporting alarm events from initiating devices in the fire alarm system.

FIG. 6 illustrates a process 600 for reporting alarm events from initiating devices in the fire alarm system. At block 602, the fire alarm control panel checks whether it has received an alarm communication from any initiating device. If not, fire alarm control panel loops back to block 602. If an alarm communication has been received, at block 604, the fire alarm control panel determines the grouping associated with the initiating device that reported the alarm communication. For example, the fire alarm control panel may access the unique address of the initiating device that reported the alarm communication, and search a look-up table (described above) that correlates the unique addresses of the initiating devices with grouping information in order to determine the grouping information for the initiating device that reported the alarm communication.

The fire alarm system then determines whether the grouping associated with the initiating device that reported the alarm communication has been reported on the output (such as user interface 40). If the grouping has already been reported, the output is not modified and the flow diagram loops to block 610. If the grouping has not already been reported, the output is modified to indicate the particular grouping of the initiating device that sent the alarm communication has an alarm event. For example, if the initiating device is in grouping #1 (or grouping 1st floor), the output on user interface 40 may be modified to indicate that an alarm event is occurring in grouping #1.

At block 610, the fire alarm control panel stores an identifier associated with the particular initiating device in a listing of initiating devices associated with the grouping that have sent an alarm communication, such as have sent an alarm communication after the last alarm communication has been cleared at the fire alarm control panel. As discussed above, the user interface indicates an alarm event by grouping as opposed to indicating an alarm event by individual initiating device. In the event that the system operator or first responder wishes to see the detail of each initiating device that has sent an alarm event, the operator may use an input device, such as a keyboard, a mouse or touch screen, on user interface 40 to request the information. The user interface 40 may then display the detail of each initiating device that has sent an alarm event. For example, if a particular grouping includes 20 initiating devices, with 8 of which sending alarm events, the fire alarm control panel may provide additional information in the event that the operator requests it. The additional information may be in the form of a percentage of initiating devices that have reported alarm events (e.g., 8 out of 20), may be in the form of a tally of the number of initiating devices that have reported alarm events, and/or may be in the form of listing each of the initiating devices that have reported alarm events.

Instructions for configuring the fire alarm system in the processes discussed above may be stored on any computer readable medium. As used herein, a "computer readable medium" includes, but is not limited to, non-volatile media, and volatile media. Non-volatile media may include, for example, optical disks, and magnetic disks. Volatile media may include, for example, semiconductor memories, and dynamic memory. The computer readable medium may be any non-transitory medium. Common forms of a computer readable medium may include, but are not limited to, a floppy disk, a flexible disk, a hard disk, a magnetic tape, other magnetic medium, an application specific integrated circuit (ASIC), a compact disk CD, other optical medium, a random access memory (RAM), a read only memory (ROM), a memory chip or card, a memory stick, and other media from which a computer, a processor or other electronic device can read.

Instructions for controlling or commanding a device in the process discussed above, such as disclosed in FIGS. 3-6, may be stored on any logic. As used herein, "logic", includes but is not limited to hardware, firmware, software in execution on a machine, and/or combinations of each to perform a function(s) or an action(s), and/or to cause a function or action from another logic, method, and/or system. Logic may include, for example, a software/firmware-controlled microprocessor, an ASIC, an analog circuit, a digital circuit, a programmed logic device, and a memory device containing instructions.

Although specific embodiments have been described and illustrated, the invention is not to be limited to the specific forms or arrangements of parts so described and illustrated. The scope of the invention is to be defined by the claims appended hereto and their equivalents. It is intended that the foregoing detailed description be understood as an illustration of selected forms that the invention can take and not as a definition of the invention. It is only the following claims, including all equivalents, which are intended to define the scope of this invention.

The invention claimed is:

1. A method for configuring an alarm system comprising a plurality of signal line circuits, the method comprising:

automatically determining to which signal line circuit, from the plurality of the signal line circuits, one or more alarm devices in the alarm system are connected;

automatically assigning a zone for the one or more alarm devices based at least in part on the signal line circuit to which the one or more alarm devices are connected;

receiving a communication from the one or more alarm devices; and reporting the communication from the one or more alarm devices based on the assigned zone.

2. The method of claim 1, wherein the one or more alarm devices comprise initiating devices.

3. The method of claim 1, further comprising:

automatically creating a label for the one or more alarm devices based on the automatically assigned zone.

4. The method of claim 3, wherein automatically creating the label based on the automatically assigned zone comprises automatically associating an indication of the assigned zone with the one or more alarm devices.

5. The method of claim 4, wherein automatically creating the label further comprises automatically associating topology information for the one or more alarm devices with the indication of the assigned zone.

6. The method of claim 3, wherein automatically creating the label further comprises automatically associating a unique address with the indication of the assigned zone.

7. The method of claim 1, wherein automatically determining to which signal line circuit the one or more alarm devices are connected comprises determining a communication port for communicating with the one or more alarm devices; and wherein automatically assigning the zone is based on the determined communication port.

8. The method of claim 7, wherein automatically assigning the zone comprises:

accessing a look-up table correlating communication ports for a fire alarm panel of the fire alarm system with sections of a building; and automatically assigning the zone based on the accessed look-up table.

9. A method for reporting a fire alarm event in a fire alarm system, the method comprising:

receiving a first indication of a fire alarm event from a first initiating device in a first grouping;

determining grouping information for the first initiating device;

organizing presentation of the indication of the alarm event based on the determined grouping information;

presenting, on an output device, the organized presentation of the indication of the fire alarm event;

receiving a second indication of the fire alarm event from a second initiating device;

determining whether the second initiating device is in the first grouping;

in response to determining that the second initiating device is in the first grouping, maintaining the organized presentation of the indication of the fire alarm event based on the grouping information; and in response to determining that the second initiating device is not in the first grouping, modifying the organized presentation of the indication of the fire alarm event to include an indication of the grouping information associated with the second initiating device.

10. The method of claim 9, further comprising:

compiling a tally of a number of initiating devices in the first grouping that have sent an indication of the fire alarm event; and receiving a request from a user input device to provide additional information on the first grouping; and outputting an indication of the tally of the number of initiating devices in the first grouping.

11. An initiating device for use in a fire alarm system, the initiating device comprising:

a communications interface configured to communicate with a fire alarm control panel in the fire alarm system;

a grouping input device configured to receive operator input grouping information input via the initiating device, the operator input grouping information indicative of at least one grouping selected from a plurality of groupings for the initiating device in the fire alarm system; and a controller in communication with the grouping input device and the communications interface, the controller configured to:

in response to receiving a command from the communications interface to send grouping information to the fire alarm control panel, determine the operator input grouping information; and send a response to the command, the response including an indication of the operator input grouping information.

12. The initiating device of claim 11, further comprising a memory configured to store the operator input grouping information, the memory in communication with the controller; and wherein the controller determines the operator input grouping information by accessing the memory.

13. The initiating device of claim 11, wherein the grouping input device comprises a manual grouping input device configured to receive a manual input from an operator.

14. The initiating device of claim 11, wherein the grouping input device is configured to receive one of a plurality of inputs, the plurality of inputs indicative of different groupings for a fire alarm zone.

15. A fire alarm control panel configured to control an alarm system comprising a plurality of signal line circuits, the fire alarm control panel comprising:

a communications interface configured to communicate with one or more alarm devices in the alarm system; and a controller in communication with the communications interface, the controller configured to:

automatically determine to which signal line circuit, from the plurality of the signal line circuits, the one or more alarm devices are connected;

automatically assigning a zone for the one or more alarm devices based at least in part on the signal line circuit to which the one or more alarm devices are connected;

receive a communication from the one or more alarm devices; and report the communication from the one or more alarm devices based on the assigned zone.

16. The fire alarm control panel of claim 15, wherein the one or more alarm devices comprise initiating devices.

17. The fire alarm control panel of claim 16, wherein the controller is further configured to:

automatically create a label for the initiating devices by automatically associating an indication of the assigned zone with the initiating devices.

18. The fire alarm control panel of claim 15, wherein the controller is configured to automatically determine to which signal line circuit the one or more alarm devices are connected by determining a communication port for communicating with the one or more alarm devices; and wherein the controller is configured to automatically assign the zone based on the determined communication port.

19. The fire alarm control panel of claim 18, further comprising a memory configured to store a look-up table correlating communication ports for the fire alarm control panel of the fire alarm system with sections of a building; and wherein the controller is configured to automatically assign the zone by:

accessing the look-up table correlating communication ports for a fire alarm panel of the fire alarm system with sections of a building; and automatically assigning the zone based on the accessed look-up table.

20. A fire alarm control panel comprising:

a communications interface for communicating with one or more alarm devices;

an output device; and a controller in communication with the communications interface and the output device, the controller configured to:

receive, via the communications interface, a first indication of a fire alarm event from a first initiating device in a first grouping;

determine grouping information for the first initiating device;

organize presentation of the indication of the alarm event based on the determined grouping information;

present, on the output device, the organized presentation of the indication of the fire alarm event;

receive, via the communications interface, a second indication of the fire alarm event from a second initiating device;

determine whether the second initiating device is in the first grouping;

in response to determining that the second initiating device is in the first grouping, maintain the organized presentation of the indication of the fire alarm event based on the grouping information; and in response to determining that the second initiating device is not in the first grouping, modify the organized presentation of the indication of the fire alarm event to include an indication of the grouping information associated with the second initiating device.

* * * * *